United States Patent [19]

Nishikawa et al.

[11] Patent Number: 4,729,939

[45] Date of Patent: Mar. 8, 1988

[54] ALUMINUM ALLOY SUPPORT FOR LITHOGRAPHIC PRINTING PLATES

[75] Inventors: Yasuhisa Nishikawa; Tadayuki Katoh; Misako Kawasaki, all of Ihara; Kazushige Takizawa, Haibara, all of Japan

[73] Assignees: Nippon Light Metal Company Limited, Tokyo; Fuji Photo Film Co. Ltd., Minamiashigara, both of Japan

[21] Appl. No.: 888,255

[22] Filed: Jul. 23, 1986

[30] Foreign Application Priority Data

Jul. 25, 1985 [JP] Japan ..... 60-162871
Sep. 30, 1985 [JP] Japan ..... 60-214630

[51] Int. Cl.[4] ..... G03C 1/94

[52] U.S. Cl. ..... 430/278; 430/165; 420/543; 420/544; 420/547

[58] Field of Search ..... 420/544, 547, 543; 428/606, 687; 148/440; 101/459; 430/278, 165

[56] References Cited

U.S. PATENT DOCUMENTS

| | | | |
|---|---|---|---|
| 2,344,510 | 3/1944 | Hagelin | 101/459 |
| 3,841,919 | 10/1974 | Hasegawa et al. | 148/440 |
| 3,852,122 | 12/1974 | Aarflot et al. | 148/440 |
| 3,911,819 | 10/1975 | Pryor et al. | 101/459 |
| 4,019,931 | 4/1977 | Setzer et al. | 148/440 |
| 4,211,619 | 7/1980 | Usbeck | 101/459 |
| 4,431,463 | 2/1984 | Althoff | 148/440 |
| 4,435,230 | 3/1984 | Fujikura | 420/547 |
| 4,610,946 | 9/1986 | Shirai et al. | 430/278 |

FOREIGN PATENT DOCUMENTS

| | | | |
|---|---|---|---|
| 6451 | 2/1974 | Japan | 420/544 |
| 29301 | 3/1977 | Japan | 101/459 |
| 220395 | 12/1984 | Japan | 101/459 |
| 1421710 | 1/1976 | United Kingdom | 101/459 |
| 2047274A | 11/1980 | United Kingdom | 101/459 |
| 404879 | 7/1974 | U.S.S.R. | 420/544 |

*Primary Examiner*—John J. Zimmerman
*Attorney, Agent, or Firm*—William J. Daniel

[57] ABSTRACT

An aluminum alloy support for lithographic printing plates produced by cold rolling an aluminum alloy composed substantially of Mg 0.05 to 3 wt %, Si 0.05 to 0.7 wt %, Zr 0.01 to 0.25 wt %, and Fe 0.05 to 0.4 wt %, with the balance being Al and impurities, and imparting a grained surface to the plate surface has high mechanical strength, good heat softening resistance, excellent water retentive property, and long press life.

7 Claims, No Drawings

ALUMINUM ALLOY SUPPORT FOR LITHOGRAPHIC PRINTING PLATES

BACKGROUD OF THE INVENTION

1. Field of the Invention

The present invention relates to an aluminum alloy support for a lithographic printing plate and, more particularly, is concerned with an aluminum alloy support for a lithographic printing plate having high mechanical strength, excellent beat softening resistance, excellent water retentive property, and long press life.

2. Description of the Prior Art

Heretofore, plates of aluminum and aluminum alloys have been in general use as the support for lithographic printing plates because of their advantages of light weight, corrosion resistance, easy work ability, and excellent in adaptability to surface treatments.

Conventionally, the aluminum used for the support of lithographic printing plates is usually made of AA1050 (purity 99.5 wt % Al) AA1100 (purity 99.0 wt % Al), or AA3003 (Al-0.05 to 0.2 wt % Cu-1.0 to 1.5 wt % Mn alloy). These aluminum plates undergo a surface graining treatment which makes the surface water retentive. The surface graining treatment can be accomplished by mechanical, chemical or electrochemical techniques. The grained surface is subsequently anodized and coated with a photosensitive composition, then dried. The resulting product is referred to as the "pre-sensitized" plate (PS plate). The PS plate undergoes the normal plate making steps such as image exposure, development, washing, and lacquer coating. The thus finished plates are ready for printing.

The operative principle of lithographic printing plate is as follows. Upon image exposure, the photosensitive layer coated on the aluminum support undergoes photochemical reactions which make the exposed parts and unexposed parts different in solubility to a developing solution. Either one of the exposed parts or unexposed parts is dissolved or peeled off to bare the aluminum therebeneath, and the other remains on the aluminum support to form the printing region. This printing region is receptive to ink. On the other hand, at the non-image or background region the aluminum support is revealed, which is hydrophilic and receptive to water.

The resulting printing plate is attached, with both ends thereof folded, onto the plate cylinder of a printing machine. The printing plate is supplied with water by so-called fountain solution so that a film of dampening water is formed on the non-image region, and then a greasy printing ink is applied to the printing plate so that the image region is covered with ink. The ink on the image area is transferred to paper by way of the blanket cylinder. Printing is performed by repeating these steps.

Usually the printing plate prepared as mentioned above can make about 100,000 good impressions if a proper selection is made from surface treatment and the photosensitive compositions to be applied to the support. Where a large volume of printing is required, the PS plate is heated at 200 to 280° C. for 3 to 7 minutes after exposure and development. This process is usually called burning. The burning process fortifies the photosensitive resin layer forming the image area.

Concomitant with recent developments in printing technology, printing speed is increasing. During printing at high speeds, the printing plate with its ends mechanically fixed to the plate cylinder receives a great deal of stress. If the printing plate lacks adequate mechanical strength, the fixed ends will be deformed or brocken or cracked by fatigue. This causes trouble in printing, and, in the worst case, makes printing impossible.

Conventional printing plate supports are not satisfactory in heat softening resistance. In other words, when they are subjected to burning at a comparatively high temperature in order to prolong press life, they are deformed by the heat. Consequently, there has been a need for an aluminum alloy support for the printing plate which is superior in mechanical strength (tensile strength and fatigue strength) and heat softening resistance, i.e., stability against deformation due to heating.

For this reason, an attempt has been made to use AA6000 aluminum alloy (Al—Mg—Si alloy), which is known as a highstrength alloy, as the support for lithographic printing plates. For example, British Pat. No. 1,421,710 disclose a support for lithographic printing plates made of aluminum plate containing Mg 0.4 to 1.2 wt % and Si 0.5 to 1.5 wt %. This alloy is an aging alloy which, upon heat treatment, forms fine crystals of $Mg_2Si$ and exhibits high mechanical strength. Supports constructed of this alloy, therefore, do not break at the folded parts. On the other hand, such plates have a disadvantage that the surface is not uniformly grained, especially where surface graining is performed by electrolytic etching. Uneven etching leads to scumming because the background region is not uniformly hydrophilic. This tendency becomes more pronounced as the Si content increase relative to Mg content. The suport of the conventional Al—Mg—Si alloy is satisfactory in mechanical strength but unsatisfactory in heat softening resistance.

With the above-mentioned in mind, the present inventors carried out extensive studies to find an aluminum alloy for lithographic printing plates which has high mechanical strength, good heat softening resistance, and good water retentive property. An aluminum plate combining these properties has been obtained in the following manner. To a melt of an Al—Mg—Si alloy having a specific compostion, a small amount of Zr is added, and the melt is cast with water cooling. The resulting slab undergoes hot rolling and cold rolling in the usual way, followed by annealing. The alloy plate obtained in this way is used for the plate support. The support readily undergoes surface graining treatment, especially by electrolytic etching. The resulting plate is comparable in mechanical strength to plates of conventional Al—Mg—Si alloy, and has good heat softening resistance and good water retentive property.

SUMMARY OF THE INVENTION

Accordingly, it is an object of the present invention to provide an aluminum alloy support for lithographic printing plate which is produced by cold rolling an aluminum alloy composed of Mg 0.05 to 3 wt %, Si 0.05 to 0.7 wt %, Zr 0.01 to 0.25 wt %, Fe 0.05 to 0.4 wt %, Mn 0 to 0.4 wt %, Cu 0 to 0.05 wt %, Zn 0 to 0.05 wt %, and Ti 0 to 0.05 wt % with the balance being Al, and subjected to conventional surface graining.

DETAILED DESCRIPTION OF THE INVENTION

The aluminum alloy plate of this invention will now be described in detail.

First, the composition and constituents of the aluminum alloy plate will be explained. Mg and Si are uniformly dispersed, in the form of a solid solution or $Mg_2Si$ phase, in the Al matrix. They impart mechanical strength to the support. With Mg less than 0.05 wt % and Si less than 0.05 wt %, the alloy plat e does not have the required strength; and with Mg more than 3 wt % and Si more than 0.7 wt %, the alloy plate has high strength but the resultant printing plate tends to cause scumming. The preferred Mg content and Si content are 0.2 to 1.5 wt % and 0.15 to 0.5 wt %, respectively. If scumming is to be completely avoided, the Mg content and Si content should be established relative to the amoun of Fe and Mn according to the following equation which has been obtained experimentally.

$$Mg \leqq 1.73 \times Si - 0.6 \times (Fe + Mn)$$

Restricting the content of Si as mentioned above substantially prevents free Si from separating out in the matrix or in the anodic oxide film, when the amount of Si in the alloy is more than necessary to form the α-Al (Fe, Mn) Si phase. As a result, the surface of the support can be grained as required and scumming due to poor corrosion resistance of the background regions can be prevented.

Zr prevents coarse $Mg_2Si$ crystals from separating out in the matrix while the rolled plate is undergoing a final heat treatment. It also improves the etching property of the support during surface treatment. In other words, Zr is necessary to form a uniform hydrophilic surface on the support. An amount of Zr less than 0.01 wt % does not fully produce the above-mentioned effect; and Zr in excess of 0.25 wt % achieves the above-mentioned improvement only with a concomitant side effect that the crystalline structure becomes uneven during hot rolling, giving rise to crystal grain streaks. The preferred amount of Zr is 0.01 to 0.15 wt %. Since Zr delays the recrystallization of the alloy, it effectively prevents the plate from becoming dull or distorted by heat.

Fe and Mn restrain the cast structure from becoming coarse and also restrain the recrystallized structure from becoming coarse. If either of them exceeds 0.4 wt % in amount, the intermetallic compound containing Fe and Mn which is formed at the time of casting becomes coarse. This aggravates the printing performance of the plate. The content of each of Fe and Mn should be less than 0.4 wt % and their total content should not exceed 0.5 wt %.

Cu, Zn and Ti are unavoidable impurities contained in this kind of alloy. Their presence up to about 0.05 wt % is permissible. Incidentally, Cu in an amount of 0.002 to 0.04 wt % is desirable because it improves the etching performance of the alloy.

The aluminum alloy is made into the lithographic printing plate in the following manner.

At first, a melt of the above-constituted aluminum alloy is prepared in the usual way, and the melt is cast into a slab. Continuous casting with water cooling is preferable. For casting into slabs, it is desirable to add less than 0.05 wt % of Ti and less than 0.01 wt % of B in order to make the cast structure fine. The cast slabs are kept at 460 to 600° C. for 2 hours in the usual way for homogenization. Then the slabs are rolled to a proper thickness by hot rolling and cold rolling, followed by solution treatment at 400 to 600° C. in the usual way. The rolled plate further undergoes cold rolling at a draft more than 10%, preferably more than 20%, so that the final product has a thickness of 0.1 to 0.5 mm. If necessary, the last cold rolling may be preceded by batchwise or continuous annealing at 140° C. for 2 hours. Moreover, if necessary, the last cold rolling may be followed by batchwise annealing at 100° to 250° C. or continuous annealing at 200° to 350° C. for less than 2 hours.

The aluminum alloy plate produced as mentioned above contains Al—Fe compounds or Al—Fe(Mn)—Si compounds dispersed therein. The Mg and Si in the mechanically worked structure are uniformly dispersed in the form of a solid solution or fine (Mg, Si) phase in the matrix. This provides the plate with good mechanical strength and permits the plate surface to be grained uniformly.

The aluminum alloy plate produced as mentioned above is cleaned with an organic solvent or an acid or alkaline solution, if necessary. Subsequently, the surface of the aluminum alloy plate is grained by any known conventional mechanical or electrochemical method (or electrolytic method) or a combination of the two. An electrochemical method or the combination of a mechanical graining method and an electrochemical graining method forms a desirable grained surface having good water retentive property with a minimum of scumming.

Mechanical graining method includes, for example, brush graining method using a wire brush or nylon brush, the ball graining method using balls or abrasives, and honing method using abrasives under high pressure. These methods may be used individually or in combination with one another. After graining, the aluminum surface should preferably be washed with an acid or alkaline solution to remove the abrasives or abraded material remained on the surface.

Electrochemical graining method may be accomplished by using an aqueous solution of hydrochloric acid or nitric acid as the electrolyte. The concentration of hydrochloric acid solution is 0.3 to 3 wt %, and the concentration of nitric acid solution should be 0.5 to 5wt %. Electrolysis is carried out at 10° to 40° C. with an AC current of sinusoidal, rectangular, or trapezoidal waveform, or a pulse current. The electrolyte may contain as a corrosion inhibitor a small amount of sodium chloride, ammonium chloride, sodium nitrate, ammonium nitrate, trimethylamine, diethanolamine, sulfuric acid, phosphoric aicd, boric acid, chromic acid, or sulfosalicyclic acid.

After electrochemical graining, the aluminum alloy plate is optionally immersed in an acid or alkaline aqueous solution to remove smut from the surface, followed by neutralization. The product thus obtained is used as the support for lithographic printing plates.

for improved adhesion to the photosensitive layer and also for improved abrasion resistance, the grained surface may be coated with a porous anodic oxide film. This is accomplished by an ordinary anodizing process that employs as the electrolyte an aqueous solution of sulfuric acid, oxalic acid, phosphoric acid chromic acid, or sulfamic acid.

The anodized aluminum plate is further immersed in an aqueous solution of alkali metal silicate (e.g., sodium silicate) as disclosed in U.S. Pat. Nos. 2,714,066 and 3,181,461, or provided with a subbing layer of a hydrophilic cellulose (e.g., carboxymethylcellulose) containing a water-soluble metal salt (e.g., zinc acetate) as disclosed in U.S. Pat. No. 3,860,426.

The support for lithographic printing plates prepared as mentioned above is provided with a photosensitive layer of the type conventionally used for PS plates. Thus, there is obtained a photosensitive lithographic printing plate of good performance.

Examples of the composition for the foregoing photosensitive layer are as follows:

(1) Photosensitive compositions composed of a diazo resin and a binder:

Preferred diazo resins are disclosed in U.S. Pat. Nos. 2,063,631 and 2,667,415; Japanese Patent Publication Nos. 48,001/74; 45,322/74; and 45,323/74; U.K. Pat. No. 1,312,925, etc., and preferred binders are disclosed in U.K. Pat. Nos. 1,350,521 and 1,460,978; and U.S. Pat. Nos. 4,123,276; 3,751,257; 3,660,097, etc.

(2) Photosensitive compositions composed of an oquinonediazide compound:

Particularly preferred o-quinonediazide compounds are o-naphthoquinonediazide compounds as disclosed in, for example, U.S. Pat. Nos.2,766,118; 2,767,092; 2,772,972; 2,859,112; 2,907,665; 3,046,110; 3,046,111; 3,046,115; 3,046,118; 3,046,119; 3,046,120; 3,046,121; 3,046,122; 3,046,123; 3,061,430; 3,102,809; 3,106,465; 3,635,709; and 3,647,443.

(3) Photosensitive compositions composed of an acid compound and a binder (high molecular compound):

Examples include compositions composed of azide compounds and a water-soluble or alkali-soluble high molecular compound disclosed in U.K. Patent Nos. 1,235,281 and 1,495,861 and Japanese Patent Laid-Open Nos. 32,331/76; 36,128/76, etc., and compositions composed of a polymer having an azide group and a high molecular compound as a binder disclosed in Japanese Patent Laid-Open Nos. 5102/75; 84,302/75; 84,303/75 and 12,984/78.

(4) Other photosensitive compositions:

Examples of other photosensitive compositions used for photosensitive lithographic printing plates include compositions containing the polyester compounds disclosed in Japanese Patent Laid-Open No. 96,696/77; compositions containing the polyvinyl cinnamate resins disclosed in U.K. Pat. Nos. 1,112,277; 1,313,390; 1,341,004; 1,377,747, etc.; and compositions containing the photopolymerizable type photopolymers disclosed in U.S. Pat. Nos. 4,072,528 and 4,072,527.

A positive-type photosensitive layer containing a polymer compound having repeating units of an orthocarboxylic acid ester which is decomposed by an acid as disclosed in Japanese Patent Laid-Open No. 17345/81. A positive-type photosensitive layer containing a compound having a silyl ester group wjich is decomposed by an acid as disclosed in Japanese Patent Laid-Open No. 10247/85. A positive-type photosensitive layer containing a compound having a silyl ether group which is decomposed by an acid, as disclosed in Japanese Patent Laid-Open Nos. 37549/85 and 121446/85.

The amount (thickness) of the photosensitive layer to be provided on the support is controlled to about 0.1 to about 7 g/m$^2$, preferably 0.5 to 4 g/m$^2$.

PS plates, after imagewise exposure, are subjected to processings including a developing step in conventional manner to form resin images. For instance, a PS plate having the photosensitive layer (1) constituted with a diazo resin and a binder has unexposed portions of photosensitive layer removed by development after imagewise exposure to produce a lithographic printing plate. On the other hand, a PS plate having a photosensitive layer (2) has exposed portions of the photosensitive layer which are removed by development with an alkaline aqueous solution after imagewise exposure to produce a lithographic printing plate.

The invention is illustrated with the following examples.

EXAMPLE 1

Eight alluminum alloys A to H as shown in Table 1 were melted. Each melt was filtered through a fine porous filter and then cast into a 560 mm thick slab by DC casting method. The slab was kept at 560° C. for 4 hours for homogenization. The slab was then hot-rolled into a 6 mm thick plate. The plate of alloy A was cold-rolled into a 1.5 mm thick plate. The plate of each of alloys B to H were cold rolled into 0.6 mm thick plates. For a solution treatment, each plate was heated at a rate of 150° C./sec by transverse flux induction heating and kept at 550° C. for 5 seconds and finally cooled with water at a rate of 500° C./sec or above. After standing at room temperature for one day, the heat treated plate was cold-rolled into a 0.3 mm thick plate. In the case of alloys A, B, C, G and H, each cold-rolled plate was annealed at 180° C. for 30 minutes in a batch-type annealing furnace. In the case of alloys D, E and F, each cold-rolled plate was annealed at 250° C. for 30 minutes. The resultant aluminum alloy plates were ready for lithographic printing.

For comparison, 0.3 mm thick plates of AA-1050-H18 and AA3003-H18 were also prepared.

TABLE 1

| | Chemical Composition (wt %) | | | | | | | |
|---|---|---|---|---|---|---|---|---|
| Alloy | Si | Fe | Cu | Mn | Mg | Ti | Zr | Al |
| A | 0.10 | 0.33 | 0.018 | 0.02 | 0.14 | 0.02 | 0.11 | Balance |
| B | 0.30 | 0.30 | 0.010 | 0.02 | 0.40 | 0.02 | 0.05 | Balance |
| C | 0.33 | 0.20 | 0.012 | 0.01 | 0.60 | 0.02 | 0.04 | Balance |
| D | 0.35 | 0.22 | 0.010 | 0.02 | 0.65 | 0.02 | 0.10 | Balance |
| E | 0.52 | 0.15 | 0.015 | 0.15 | 1.10 | 0.02 | 0.14 | Balance |
| F | 0.10 | 0.30 | 0.010 | 0.05 | 1.20 | 0.02 | 0.10 | Balance |
| G | 0.09 | 0.23 | 0.008 | 0.01 | 2.64 | 0.02 | 0.14 | Balance |
| H* | 1.20 | 0.18 | 0.015 | 0.01 | 0.44 | 0.02 | — | Balance |
| AA1050-H18** | 0.08 | 0.32 | 0.003 | 0.01 | — | 0.02 | — | Balance |
| AA3003-H18** | 0.29 | 0.65 | 0.13 | 1.14 | — | 0.01 | — | Balance |

*Comparative Example
**Conventional Alloys

Each of the aluminum plates obtained above was examined for strength as follows. Yield strength (0.2%) was measured in the usual way. To evaluate heat softening resistance, yeild strength (0.2%) was measured after immersion in a salt bath at 270° C. for 7 minutes.

To evaluate fatigue resistance, bent specimen fatigue strength was measured as follows: A test piece measuring 32 mm wide and 60 mm long was cut out of the aluminum plate. The test piece was bent 90° using a printing plate bender having a radius of curvature of 1.5 mm. With one edge fixedly gripped by a jig, the test piece was subjected to repeated flexing at a constant amplitude. The number of flexing cycles until failure was recorded.

The above-mentioned ten kinds of alloy plates were processed to adapt them as lithographic printing plates. The grainability and the properties of the anodized film were evaluated as follows: Graining was performed using a rotary nylon brush in an aqueous suspension of pumice powder. The grained plate was subsequently subjected to etching with a 20 wt % aqueous solution of sodium hydroxide, followed by washing with water, washing with a 25 wt % aqueous solution of nitric acid, and washing again with water. The washed plate was subjected to electrolysis with an AC current at a current density of 20 A/dm$^2$ or above in an electrolyte bath containing 1.5 wt % of hydrochloric acid. For surface cleaning, the plate was immersed in a 15 wt % aqueous solution of sulfuric acid at 50° C. for 3 minutes. Finally the plate was anodized in an electrolyte containing 20 wt % sulfuric acid as the major component at a bath temperature of 30° C.

The grained surface of the support was examined for uniformity of grain by observation under a scanning electron microscope. The anodic film alone was separated by dissolving the aluminum base in brom-methanol solution. The film was examined for secondary phase particles remaining in the anodic oxide film under a transmission electron microscope. The results are shown in Table 2. Incidentally, the mechanical properties were measured in the rolling direction (L direction).

The support prepared as mentioned above was cut to a size of 1003 mm by 800 mm. The cut sample of the support was coated with a positive-type naphthoquinonediazide photosensitive layer, followed by exposure and development. After drying, the support was heated at 260° C. for 7 minutes in a burning processor, Model 1380, having a 12 kW heating source, available from Fuji Photo Film Co., Ltd. The support was visually examined for wavy deformation.

It is noted from Table 2 that the alloys A to G of this invention are comparable to or better than conventional alloys in 0.2 wt % yield strength, heat softening resistance (0.2 wt % yield strength after heating), and fatigue resistance bent specimen fatigue strength). The grainability and the performance of anodic oxide film were equivalent to JIS 1050-H18.

The comparative alloy H containing no Zr was slightly poor in burning resistance, despite its good mechanical strength. It was poor in grainability by electrolytic etching and water retentive property was poor. A large numer of insoluble secondary phase particles were observed in the anodic oxide film separated from the supports of alloy H. Silicon was detected from these particles by EDX analysis.

Conventional AA1050-H18 and AA3003-H18 alloys were poor in either of support strength, heat softening resistance, grainability, and properties of the anodic oxide film.

EXAMPLE 2

Samples of the ten different alloy plates of Table 1 in Example 1 were washed with trichloroethylene to remove rolling mill lubricant. The aluminum surface was cleaned with sodium hydroxide and subjected to electrolysis with an AC current at a current density of 20 A/dm$^2$ and above in an electrolyte bath containing 1.5 wt % of nitric acid. The surface was cleaned in the same way as in Example 1 and then subjected to anodization.

Each support thus prepared was coated with a light-sensitive layer having the following composition at a dry coverage of 2.5 g/m$^2$.

| | |
|---|---|
| Ester comounds of naphthoquinone-1, 2-diazido-5-sulfonyl chloride with pyrogallol and acetone resin (described in Example 1 of U.S. Pat. No. 3,635,709) | 0.75 g |
| Cresol novolak resin | 2.00 g |
| Oil Blue #603 (product of Orient Chemical Co., Ltd.) | 0.04 g |
| Ethylene dichloride | 16 g |
| 2-Methoxyethylacetate | 12 g |

The photosensitive lithographic printing plates thus prepared were then exposed and developed in the conventional manner and then subjected to a burning treatment at 260° C. for 7 minutes.

TABLE 2

| Alloy | 0.2 wt % yield strength at room temp. (kg/mm$^2$) | Heat softening resistance: 0.2 wt % yield strength (kg/mm$^2$) | Heat softening resistance: Wavy irregularities | bent specimen: fatigue strength (cycles × 10$^4$) | State of grained surface | Properties of anodic oxide film |
|---|---|---|---|---|---|---|
| A | 20.9 | 16.5 | good | 36.6 | good | good |
| B | 20.5 | 17.0 | good | 26.0 | good | good |
| C | 25.0 | 17.4 | good | >40 | good | good |
| D | 21.7 | 16.7 | good | >40 | good | good |
| E | 22.6 | 21.2 | good | >40 | good | good |
| F | 18.4 | 16.4 | good | >40 | good | good |
| G | 22.2 | 17.9 | good | >40 | good | good |
| H* | 30.5 | 16.5 | fair | >40 | poor[1] | poor[2] |
| AA1050-H18** | 14.7 | 3.0 | poor | 5.23 | good | good |
| AA3003-H18** | 19.9 | 15.6 | fair | 24.0 | poor[1] | poor[2] |

*Comparative Examples
**Conventional Alloys
[1]Some parts remained unetched
[2]There were residual particles of the secondary phase.

A press life was carried out using a KOR sheet fed press. The results are shown in Table 3.

TABLE 3

| Alloy | Uniformity of grained surface | Scumming resistance | Press life** |
|---|---|---|---|
| A | good | good | 150,000 |
| B | good | good | 150,000 |
| C | good | good | 150,000 |
| D | good | good | 150,000 |
| E | good | good | 150,000 |
| F | good | good | 150,000 |
| G | good | good | 150,000 |
| H* | uneven | poor | 70,000 |
| AA1050-H18 | good | good | 100,000 |
| AA3003-H18 | uneven | poor | 100,000 |

*Comparative Examples
**Number of impressions

It is noted from Table 3 that the alloy plates A to G of this invention are capable of electrochemical graining to form the uniform surface, and the printing plates produced from them had a long press life with a minimum of scumming. In the case of comparative alloy H and conventional AA3003-H18, the uneven surface were obtained and scumming occurred due to the secondary phase particles remaining in the anodic oxide film. Consequently the printing plates produced from them had a short press life.

What is claimed is:

1. A photosensitive lithographic printing plate comprising an aluminum alloy support plate and a photosensitive layer thereon, said plate having been produced by cold rolling into plate form an aluminum alloy consisting essentially of Mg 0.05 to 3 wt %, Si 0.05 to 0.7 wt %, Zr 0.01 to 0.25 wt %, and Fe 0.05 to 0.4 wt %, with the balance being Al and impurities, the plate surface having been subjected to a graining treatment.

2. A printing plate as set forth in claim 1, wherein the total weight of Fe and Mn is less than 0.5 wt % with the amount of Mn alone being less than 0.4 wt %, and the weight relationship of Mg to Si conforms to the empirical equation $Mg \leqq 1.73 \times Si - 0.6 \times (Fe + Mn)$.

3. A printing plate as set forth in claim 1, wherein said impurities comprise at least one member selected from the group consisting of less than 0.05 wt % of Cu, less than 0.05 wt % of Zn, and less than 0.05 wt % of Ti.

4. A printing plate as set forth in claim 1, wherein said aluminum alloy consisting essentially of Mg 0.2 to 1.5 wt %, Si 0.15 to 0.5 wt %, Zr 0.01 to 0.15 wt %, and Fe 0.05 to 0.4 wt %, with the balance being Al and impurities.

5. A printing plate as set forth in claim 1, wherein said graining treatment was selected from wire brush graining, ball graining, and honing graining.

6. A printing plate as set forth in claim 1, wherein said surface graining treatment was by electrolytic etching with a hydrochloric acid solution or nitric acid solution as the electrolyte.

7. The printing plate of claim 1 wherein said Mg is present in the range of about 0.2 to 1.5 wt % and said Si is present in the range of about 0.15 to 3 wt %.

* * * * *